United States Patent [19]

Simms

[11] 4,064,613

[45] Dec. 27, 1977

[54] POWER STEERING PUMP BRACKET TOOL

[75] Inventor: John E. Simms, Kingsville, Md.

[73] Assignee: Design & Funding, Inc., Baltimore, Md.

[21] Appl. No.: 784,358

[22] Filed: Apr. 4, 1977

[51] Int. Cl.[2] ..... B25B 23/00

[52] U.S. Cl. ..... 29/407; 74/242.8; 81/3 R; 81/90 B

[58] Field of Search ..... 29/407, 283; 81/3 R, 81/64, 90 R, 90 E, 66 R, DIG. 8; 254/133 R, 131, 120; 74/242.8, 242.13 R, 242.12

[56] References Cited

U.S. PATENT DOCUMENTS

| | | | |
|---|---|---|---|
| 1,936,359 | 11/1933 | Huthsing et al. | 81/90 B X |
| 3,063,315 | 11/1962 | Bernor et al. | 81/90 B |

*Primary Examiner*—Milton S. Mehr
*Attorney, Agent, or Firm*—Pawl & Moore

[57] ABSTRACT

A method and apparatus for positioning the power steering pump of an automobile so that the bracket may be adjusted for optimum drive belt tension.

4 Claims, 3 Drawing Figures

POWER STEERING PUMP BRACKET TOOL

THE INVENTION

This invention relates to a method and apparatus for tensioning the drive belt for a power steering pump by applying pressure to the pump housing final support bracket.

BACKGROUND OF THE INVENTION

Many contemporary automobiles incorporate power steering units which derive energy from a drive belt coupled via a pulley network to the engine drive shaft. The drive belt must be properly tensioned to provide adequate power and prevent belt slippage. This requires that the pump housing be physically urged in a direction which will tension the belt while the pump support housing bracket adjustment nuts and bolts are tightened.

In most installations the power steering pump housing is constructed of relatively thin metal which can be easily damaged if a crow bar or similar tool is used to wedge the unit away from the engine block to create the required drive belt tension. Moving the unit by hand also creates problems since the amount of tension required necessitates that a relatively high force be applied to the unit. This force, in many instances, can not be created simply by pulling the unit with ones hand.

OBJECT OF THE INVENTION

Therefore, it is an object of the present invention to provide a means to apply the required force to a power steering pump housing so that the drive belt may be tensioned properly.

It is a further objective of this invention to provide an apparatus adapted to slip onto the final mounting bracket of a power steering pump housing in a manner which will permit a lever arm to be inserted into an orifice provided in the tool so that the required force to hold the power steering pump housing against a tensioned drive belt may be imparted through the lever arm.

It is a still further objective of this invention to provide a tool which will permit tensioning a power steering housing against the pull of the drive belt without applying pressure to the pump housing.

A further objective of the present invention is to provide a tool adapted to cooperate with the final power steering pump housing bracket to provide a moving force to the power steering pump through the final bracket attachment points so that the power steering pump housing may be physically held in the proper position to develop the required drive belt tension while the adjustment nuts and bolts are secured.

SUMMARY OF THE INVENTION

This invention is directed to a method and apparatus for adjusting the tension of the drive belt for a power steering pump unit in a contemporary automobile.

The method comprises utilizing a lever arm in combination with a tool affixed to a final support bracket for the power steering pump housing and applying a force through the lever arm to move the power steering pump unit away from the primary drive pulley around which the power steering pump drive belt passes.

The tool presented by the subject patent incorporates a hook shaped end adapted to fit over the edge of a power steering pump bracket and a stop adapted to cooperate with an opposite edge of the pump bracket in combination with an offcenter section adapted to receive the coupling end of a standard drive socket ratchet, bar, or torque handle.

DESCRIPTION OF THE DRAWINGS

In the drawings, which illustrate the primary embodiments of the instant invention.

DESCRIPTION OF THE INVENTION

Figure 1:
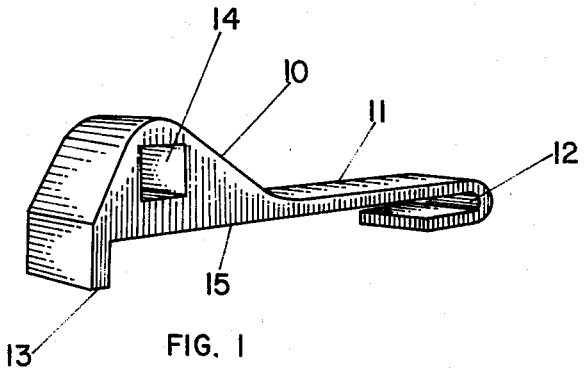
FIG. 1 is a ¾ view of the tool.
Figure 2:
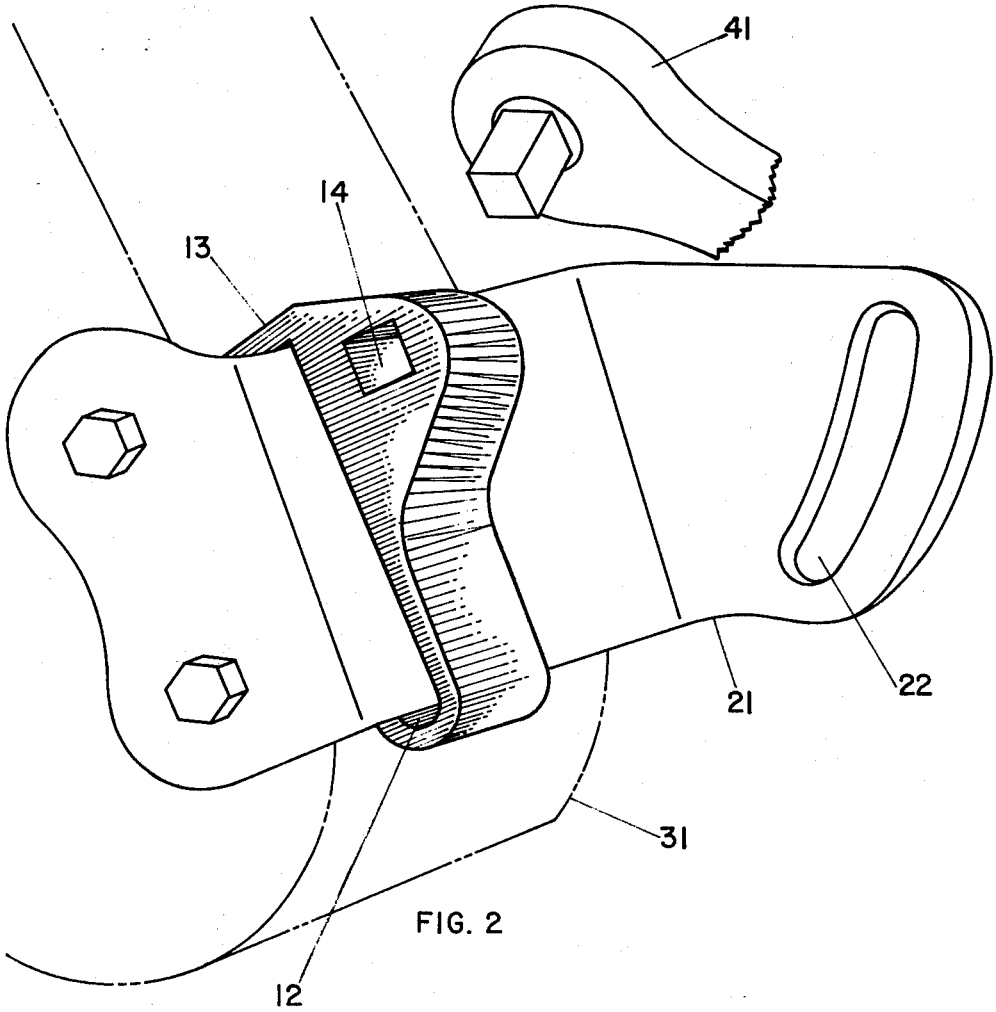
FIG. 2 illustrates the tool in place on a power steering pump bracket.
Figure 3:
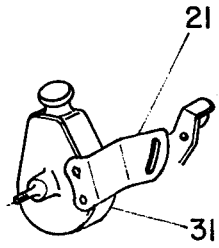
FIG. 3 presents a typical power steering pump and final bracket assembly.

Referring to the drawings, FIG. 1 illustrates the primary features of the tool shown generally at 10 which permits it to be attached to the mounting flange, 21 of FIGS. 2 and 3, for the power steering pump 31.

The tool 10, in a preferred embodiment, incorporates an elongated body section 11 having one end folded so that it will form a recess 12 which will slip over the pump support bracket 21.

The opposite end of the tool incorporates a right angle stop 13 which is adapted to cooperate with the edge of the power steering bracket opposite the point where the folded member 12 engages the bracket.

The end of the tool near the stop 13 is thickened to permit forming of a square orifice 14 which is dimensioned to cooperate with a standard square drive socket wrench, 41 of FIG. 2.

The method of using the tool includes the steps of slipping the folded portion 12 of the tool over the lower edge of the power steering pump bracket 21 and rotating the tool body so that the 90 degree stop 13 passes the opposite edge of the bracket. The flat underface 15 of the tool rests across the broad flange of the power steering pump bracket assembly when the tool is properly positioned. A standard square drive ratchet, bar, or torque handle is inserted in the socket receptacle 14 of the tool. The bolts passing through the adjustment, mounting slots 22 of the power steering pump bracket are loosened and the square drive tool handle is rotated upward and toward the right angle flange 13 of the tool so that the drive shaft 32 of the power steering pump swings away from the primary drive pulley of the engine, thus applying tension to a drive belt coupling the power steering pump to the primary drive pulley. The pump is held in this position while the adjustment bolts are tightened and the tool is then removed by rotating it in the opposite direction. This raises the shoulder 13 from engagement with the bracket and allows the bracket and folded portion of the tool 12 to be disengaged.

In an alternate embodiment of the present invention a torque wrench is used as a lever arm and a conversion chart from foot-pounds to belt tension is provided to permit proper belt tensioning without the need of additional gages.

Although the preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim as a new and useful contribution to the art and for which I desire letters patent is:

1. A tool, comprising:

a rigid body member having a flat bottom and a raised section at one end of the top of said body member; said raised section including a square opening with the bore axis perpendicular to the side plane of said rigid body member and dimensioned to accept the driving end fitting of a socket wrench tool handle;

an end stop descending from the raised section end of said body member and forming an interior 90° angle with said flat bottom; and a 180° curved lip section on the end of said body member opposite said end stop and raised section adapted to form a U shaped channel on the bottom side of said body member with the opening facing said end stop.

2. A tool as defined in claim 1, wherein: said U shaped channel is dimensioned to receive a metal strap having a thickness equal to a power steering pump bracket strap and said bottom is dimensioned to permit placing said bottom on the surface of a power steering pump bracket strap while said end stop engages one edge of said bracket strap and said channel encompasses the opposite edge of said bracket strap.

3. A method for adjusting the drive belt tension for a power steering pump, comprising the steps of: placing a U shaped channel of an adjusting tool over one edge of a power steering pump bracket strap immediately adjacent to the power steering pump housing;

rotating said tool so that a flat bottom of said tool rests flush against a flat surface of said bracket facing away from said pump housing and an end stop engages the edge of said bracket opposite the bracket edge encompassed by the U shaped channel;

rotating said tool by a handle affixed in an opening in said tool so that said power steering pump bracket and said power steering pump are pulled away from the main drive pulley of the associated motor with a force calculated to provide the required power steering pump drive belt tension; and tightening the adjustment nuts and bolts of said power steering bracket while said tool is held in said rotated position to maintain said power steering drive belt tension.

4. A method as defined in claim 3 wherein said tool handle is a torque wrench and the step of rotating said tool comprises applying pressure to said torque handle until the torque indicating means thereon indicates a value calculated to result in the proper power steering pump drive belt tension and maintaining that pressure until the bracket adjustment nuts and bolts are secured.

* * * * *